US005836481A

United States Patent [19]

Strohmeyer et al.

[11] Patent Number: 5,836,481

[45] Date of Patent: Nov. 17, 1998

[54] DISPENSER HOUSING

[75] Inventors: Darwin L. Strohmeyer, Spring Branch; John T. Hawkins, Jr., Adkins, both of Tex.

[73] Assignee: Lancer Partnership, Ltd., San Antonio, Tex.

[21] Appl. No.: 638,835

[22] Filed: Apr. 29, 1996

[51] Int. Cl.[6] ..... B67D 5/06

[52] U.S. Cl. ..... 222/182; 222/129.1

[58] Field of Search ..... 222/129.1, 129.2, 222/129.3, 129.4, 182

[56] References Cited

U.S. PATENT DOCUMENTS

| | | | |
|---|---|---|---|
| 4,679,707 | 7/1987 | Sedam | 222/129.1 |
| 4,757,920 | 7/1988 | Harootian, Jr. et al. | 222/146.6 |
| 4,960,222 | 10/1990 | Takahashi et al. | 222/129.1 |
| 5,312,017 | 5/1994 | Schroeder et al. | 222/129.1 X |

*Primary Examiner*—Joseph Kaufman

*Attorney, Agent, or Firm*—Christopher L. Makay; Donald R. Comuzzi

[57] ABSTRACT

A dispenser housing includes an enclosure that receives a dispenser therein. The enclosure includes an opening that permits access to the dispenser. The dispenser housing further includes a first access member, a second access member, and a valve casing. The first access member is secured to the enclosure and is pivotally movable between a first position and a second position that provides access to the dispenser. The valve casing is secured to the enclosure and is pivotally movable between a first position and a second position that provides access to the dispenser. The second access member is positioned proximate to the first access member and is pivotally movable between a first position and a second position that provides access to the dispenser. The second access member includes a light source that illuminates the dispenser when the second access member resides in its second position.

12 Claims, 10 Drawing Sheets

DISPENSER HOUSING

BACKGROUND OF THE INVENTION

1. Field of the Invention

The present invention relates to housings, and more particularly but not by way of limitation, to a housing for use with a dispenser.

2. Description of the Related Art

A housing surrounds and improves the aesthetics of a soda and/or ice dispenser. Typically, the housing has pivotal panels and removable plates so that a repairman services the dispenser by lifting and bracing the panels or unscrewing the plates.

The use of these conventional dispenser housings suffers several disadvantages. Conventional housings, using parts such as screws or bolts, complicate the opening of the housing and training of repairmen. Opening conventional dispenser housings wastes time in locating suitable tools. Additionally, conventional dispenser housings, having detachable parts, require extra training of repairmen that potentially is unavailable in remote areas.

Another disadvantage with conventional housings is that detachable parts, such as screws and bolts, must be accounted for during servicing. These parts if missing must be replaced, otherwise the dispenser housing's stability may be jeopardized.

Yet another disadvantage of conventional housings is that the panel covering the dispenser valves does not pivot downward. The panel, failing to pivot downward, hinders accessibility of the valves during servicing.

An additional disadvantage of conventional housings is that the removable plates and pivotal panels are sometimes difficult to reach, causing a repairman to climb to the top of the housing to remove plates or open panels for accessing the dispenser.

A further disadvantage of some conventional housings is that the water and syrup adjusters are inaccessible unless a plate is detached by removing screws or bolts.

Accordingly, a housing having unfolding facial members will improve serviceability over conventional housings.

SUMMARY OF THE INVENTION

In accordance with the aims of the present invention, one embodiment of a dispenser housing includes a face. The face has a valve casing pivotally extendable to provide access to the valves of a soda dispenser.

Another embodiment of the present invention is a jointed connection for a valve casing of a soda dispenser housing. The jointed connection includes at least one valve casing joint having a plate, a lever, and a pin. The plate has a plurality of legs extending therefrom wherein each of the legs has an aperture therethrough. The lever is insertable through the apertures. The pin is releasably engageable with the lever to permit longitudinal and pivotal movement of the valve casing.

An additional embodiment of the present invention is a dispenser unit. The dispenser unit includes a soda dispenser and a housing. The soda dispenser has at least one valve and one switch. The housing has a face which, in turn, includes a first access member pivotally movable between a first position and a second position to provide access to the soda dispenser, and a valve casing being longitudinally and pivotally extendable to provide access to the valve of the soda dispenser. The valve casing has an aperture access member and covering. The aperture access member and covering each have at least one aperture. The aperture access member is positionable to align the aperture of the aperture access member with the aperture of the covering.

It is, therefore, an object of the present invention to provide a housing that protects a dispenser.

Another object of the present invention is to provide an easily opened housing without utilizing removable fastening members.

A further object of the present invention is to provide an invention having casing members that are connected without the use of fastening members.

Another object of the present invention is to provide a housing having access openings to the dispenser valves for adjusting the water and syrup flow rates.

An additional object of the present invention is to provide an aperture access cover for permitting opening and closing of the valve adjustment apertures.

A further object of the present invention is to provide a valve casing that is longitudinally extendable and downwardly pivotal for accessing the dispenser valves.

A still further object of the present invention is to provide a casing that is easily assembled from its various components.

Still other objects, features, and advantages of the present invention will become evident to those of ordinary skill in the art in light of the following.

BRIEF DESCRIPTIONS OF THE DRAWINGS

DETAILED DESCRIPTION OF THE PREFERRED EMBODIMENT

Figure 1:
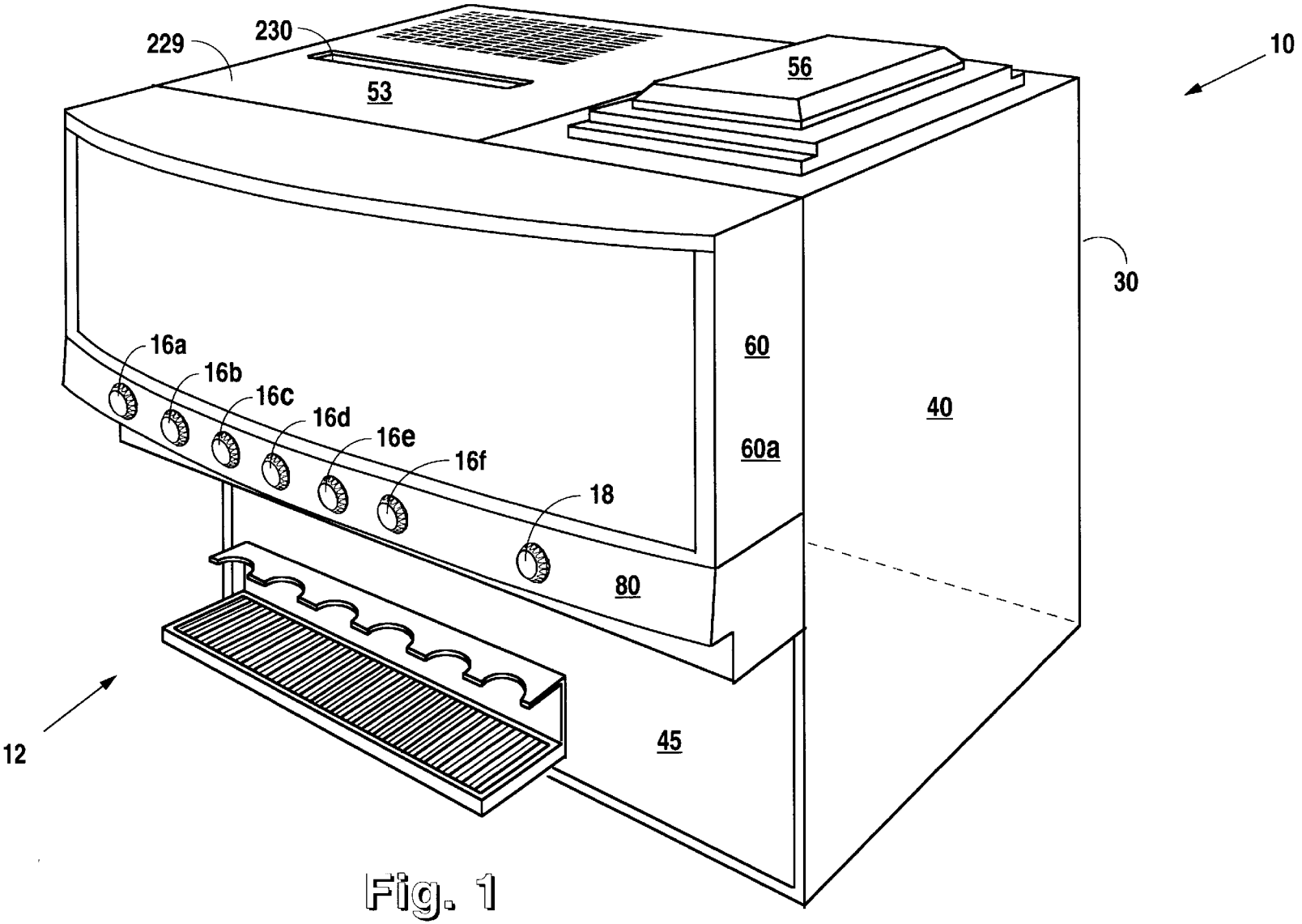
FIG. 1 is a perspective view illustrating the dispenser housing.
Figure 2:
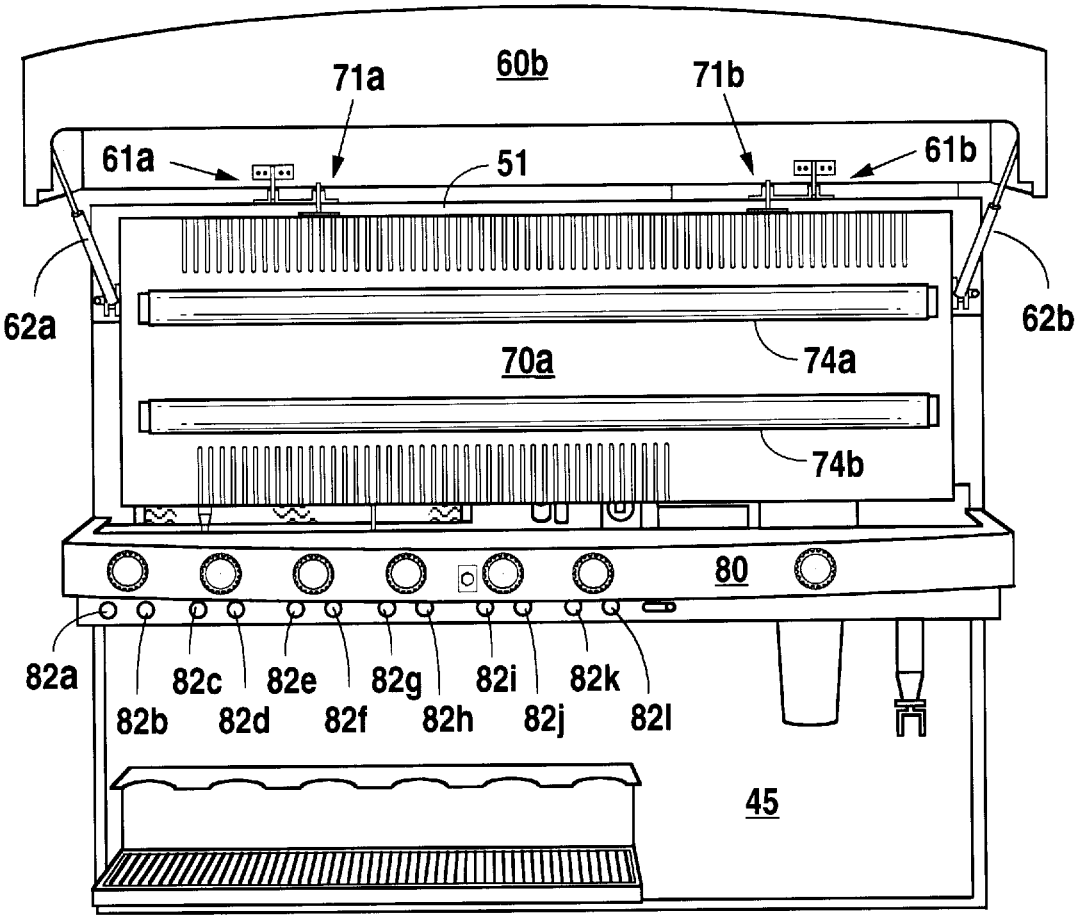
FIG. 2 is a front elevation view illustrating the dispenser housing with the first access member extended in a substantially horizontal position.
Figure 3:
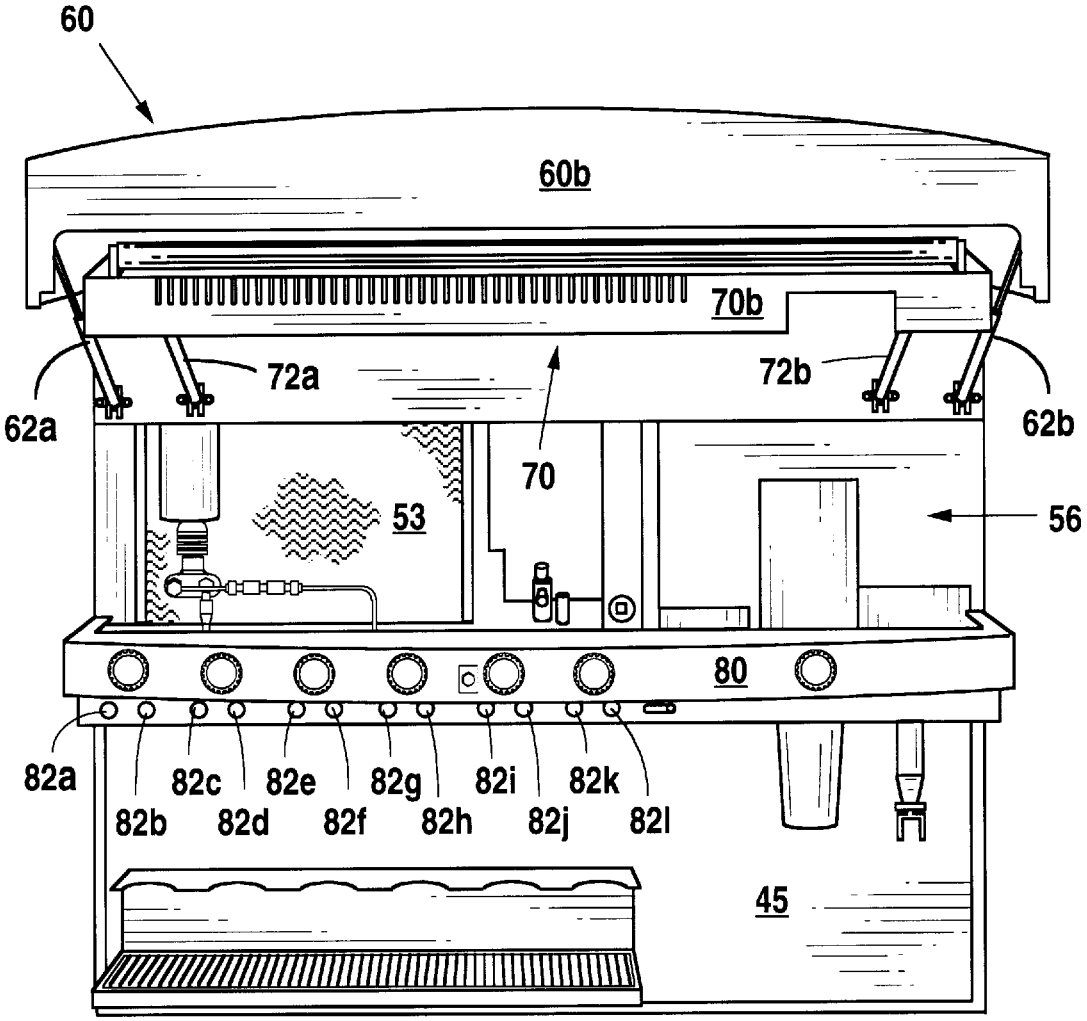
FIG. 3 is a front elevation view illustrating the dispenser housing with the second access member extended in a substantially horizontal position.

As illustrated in FIGS. 1–4, 5A–B, 6A–B and 7A–B, dispenser housing 10 includes a face 12, base 15, first casing member 20, second casing member 30, and third casing member 40. First casing member 20 and third casing member 40 have keyhole apertures 25*a–h* that attach to a respective protrusion 35*a–h* of second casing member 30. Inserting protrusions 35*a–d* of member 30 into keyhole apertures 25*a–d* of first casing member 20 and inserting protrusions 35*e–h* of member 30 into keyhole apertures 25*e–h* of third casing member 40 form the back and side walls of dispenser housing 10. Members 20, 30, and 40, preferably rectangular, mount upon base 15 and create an enclosure for placing beverage equipment, such as a soda dispenser 53 and/or an ice dispenser 56, therein. Preferably, dispenser housing 10 is sized for surrounding both of these units. Though dispenser housing 10 can be used with varying types of soda dispensers 53, preferably housing 10 is used with a soda dispenser as described below.

Face 12 includes a face casing member 45, brace 51, first access member 60, second access member 70, and valve casing 80. Soda dispenser buttons 16*a–f* and ice dispensing button 18 permit the release of soft drinks or ice respectively. Also a button 500 permits the release of water that may be carbonated.

First access member 60 is pivotally movable between a first substantially vertical position 60*a* and a second substantially horizontal position 60*b*. Brackets 61*a–b* mount first access member 60 to brace 51, preferably rectangular, which is secured to second casing member 20 and third casing member 40. Supports 62*a–b* secured to brace 51 and first access member 60, permit locking and releasing of first access member 60 in second position 60*b*. Preferably supports 62*a–b* are either stainless steel lift supports, part #11615A11, distributed by the McMaster Car Supply Company, 6100 Fulton Industrial Boulevard, Atlanta, Ga. 30336 or piston supports marketed under the tradename LIFT-O-MAT, Part #FJN344 0140N, manufactured by Stabious, 92 County Line Road, Colmar, Pa. 18915. Lifting and locking first access member 60 in second position 60*b* permit inspection of second access member 70 and light sources 74*a–b*, which are preferably florescent lights.

Second access member 70 is pivotally movable between a first substantially vertical position 70*a* and a second substantially horizontal position 70*b*. Brackets 71*a–b* mount second access member 70 to brace 51 and supports 72*a–b*, secured to brace 51 and second access member 70, permit locking and releasing of second access member 70 in second position 70*b*. Preferably supports 72*a–b* are either stainless steel lift supports or piston supports as previously described. Lifting and locking second access member 70 in second position 70*b* permit inspection of soda dispenser 53, including carbonator pump, carbonator motor, ice probes, carbonator probe, transformer reset, relief valve, and electronics; ice dispenser 56; and housing 10, including light mounts. In position 70*b*, light sources 74*a–b* remain electrically connected to an electrical source thereby illuminating dispensers 53 and 56 within housing 10.

Valve casing or third access member 80 extends outwardly to a first partially opened position 80*a* and is downwardly pivotal to a second position 80*b*, thereby permitting inspection of valves 120*a–f*. Valve casing 80 includes internal support 85, covering 86, and aperture access member 90. Internal support 85 includes an elongated substantially rectangular bar 185, arms 186*a–b*, and apertures 189*a–g*. Each arm 186*a–b* is welded to an end of bar 185. Covering 86 includes holes 199*a–g* and a body 196. Body 196, having a protruding lip 197 and slot 200, is integrally formed with arms 198*a–b*. Aligning holes 199*a–g* with apertures 189*a–g* allows the insertion of securing members, such as screws, for mounting covering 86 over support 85 to form a single unit.

A brace 84 and valve casing joints 95*a–b* anchor valve casing 80 to first casing member 20 and third casing member 40. Brace 84 includes an elongated rectangular flat plate 174 integrally formed with substantially rectangular arms 175*a–b*. Plate 174 includes openings 179*a–f* for inserting dispenser 53 outlet nozzles therethrough. Each arm 175*a–b* has a respective slot 87*a–b* extending therethrough and holes 180*a–d*. Aligning holes 180*a–b* of arm 175*a* with apertures 22*a–b* of first casing member 20 and holes 180*c–d* of arm 175*b* with apertures 42*a–b* of third casing member 40 permits attaching brace 84 to first casing member 20 and third casing member 40 with securing members, such as screws.

Joints 95*a–b* provide an extendable connection between brace 84 and valve casing 80. Joints 95*a–b* are substantially identical, therefore, only joint 95*a* will be described in detail hereinafter. Joint 95*a* includes a plate 100*a*, first securing member 104*a*, second securing member 105*a*, pin 107*a*, and lever 110*a*. Securing members 104*a* and 105*a*, preferably screws, mount plate 100*a* to arm 175*a* of brace 84. Plate 100*a* is substantially perpendicular to and formed integrally with legs 101*a* and 102*a*. Lever 110*a* is insertable through apertures 108*a* and 109*a* of legs 101*a* and 102*a*, respectively. Lever 110*a*, having a substantially inverted L-shape, is formed integrally with upwardly extending arm 112*a*. A bottom edge 113*a* of lever 110*a* forms a generally acute angle with a side edge 114*a*. Pin 107*a* extends through slot 87*a* of brace 84 and connects to internal support 85 of valve casing 80.

Pulling upwardly on levers 110*a–b* opens valve casing 80 by positioning bottom edges 113*a–b* above pins 107*a–b*. Pulling outwardly on valve casing 80 moves internal support 85 and covering 87 away from brace 84. Pin 107*a* slides along the length of slot 87*a* until it reaches outer edge 88*a* of slot 87*a*, resulting in valve casing 80 being moved to first position 80*a*. Rotating downwardly positions valve casing 80 in second position 80*b*, thereby permitting access to valves 120*a–f* of dispenser 10.

Rotating upwardly to first position 80*a* and then pushing inwardly towards dispenser 53 closes valve casing 80. After rotating upwardly, pushing inwardly slides pin 107*a* toward inner edge 89*a* of slot 87*a*. As pin 107*a* engages bottom edge 113*a*, it moves lever 110*a* upward. After pin 107*a* reaches the inner edge 89*a* of slot 87*a*, lever 110*a* falls downwardly to lock pin 107*a* and valve casing 80.

Figure 6A:
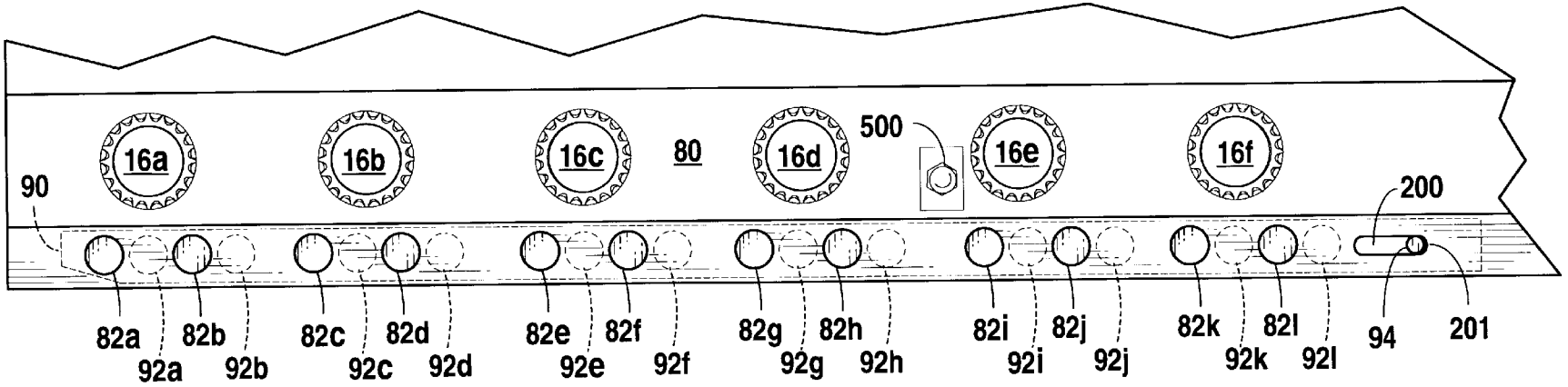
FIG. 6A is a cut-away view illustrating the aperture access cover in a closed position.
Figure 6B:
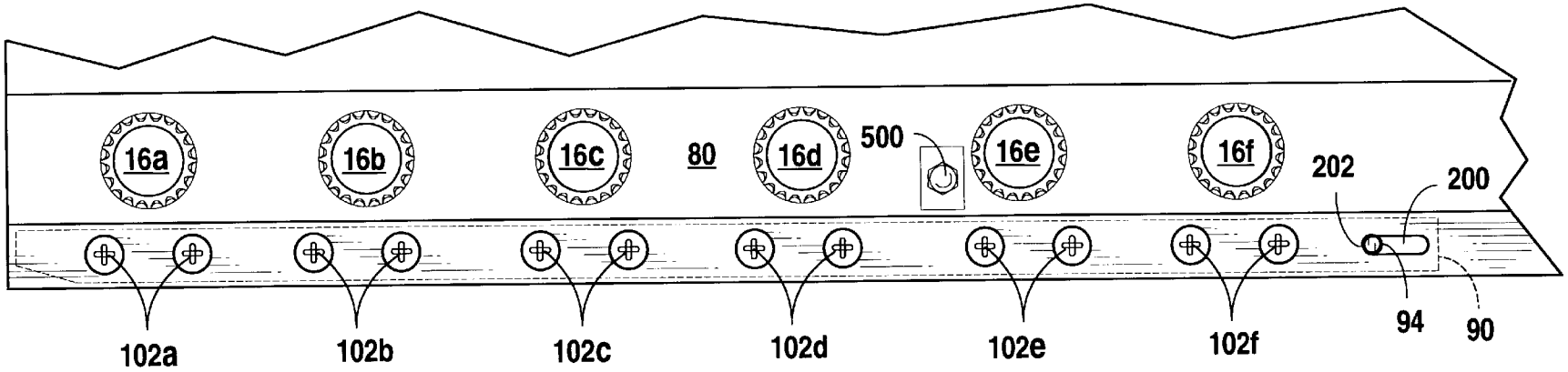
FIG. 6B is a cut-away view illustrating the aperture access member in an open position.
Figures 7A, 7B:
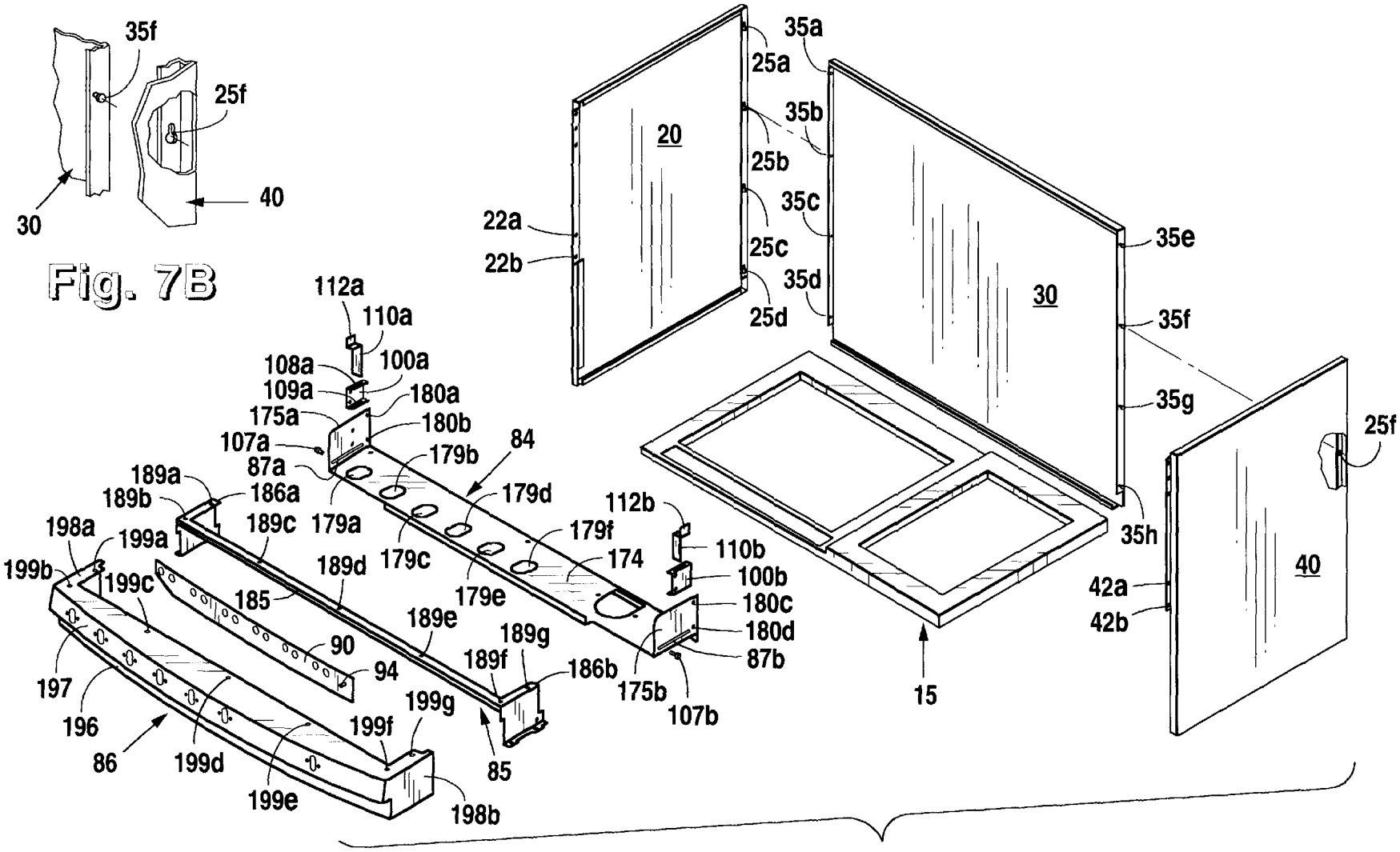
FIG. 7A is an exploded, perspective view illustrating the valve casing, brace, base, and casing members.
FIG. 7B is a cut-away view illustrating connecting the third casing member with the second casing member.
Figure 8:
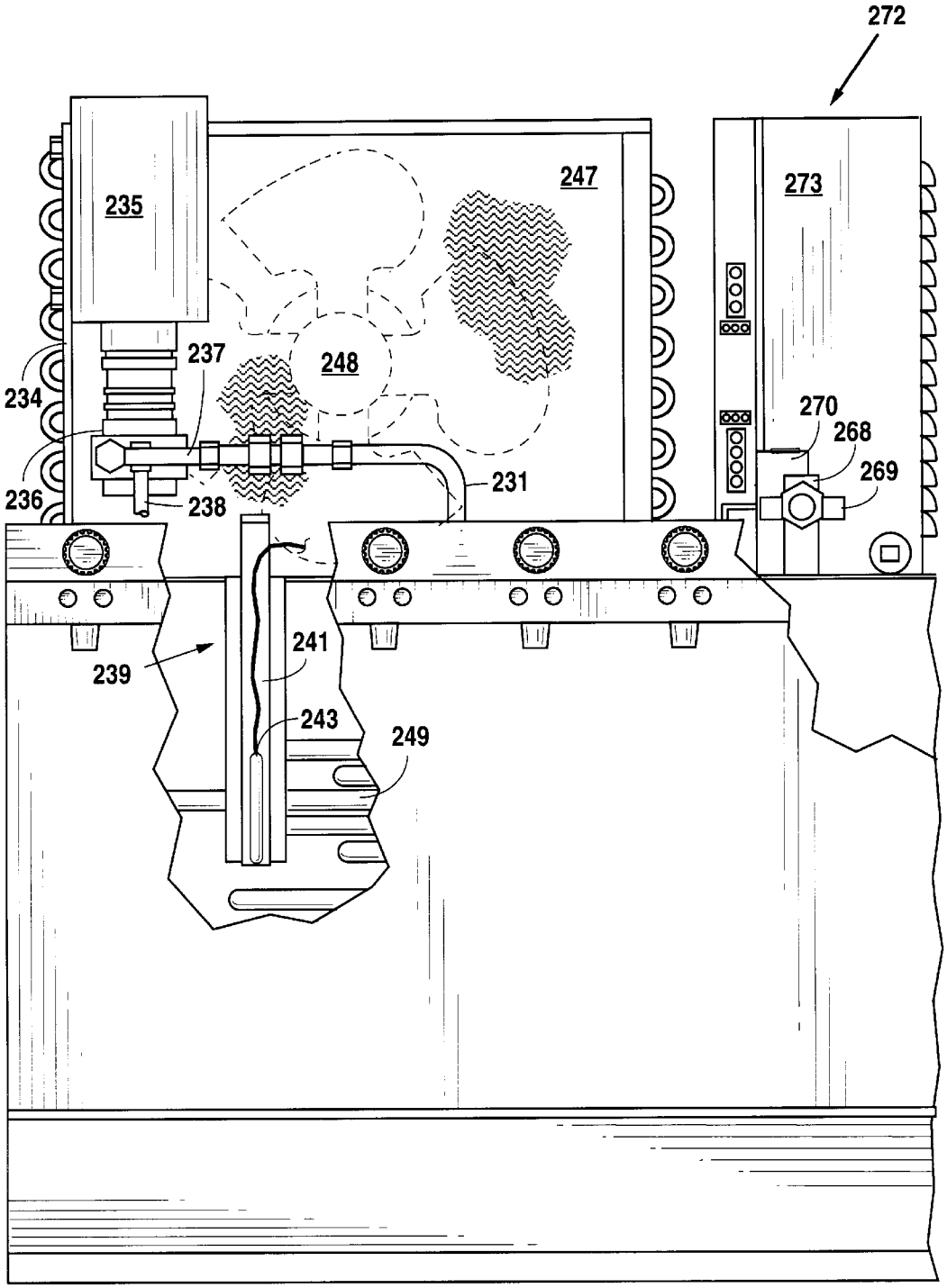
FIG. 8 is a cut-away view illustrating the dispenser according to the preferred embodiment.
Figure 9:
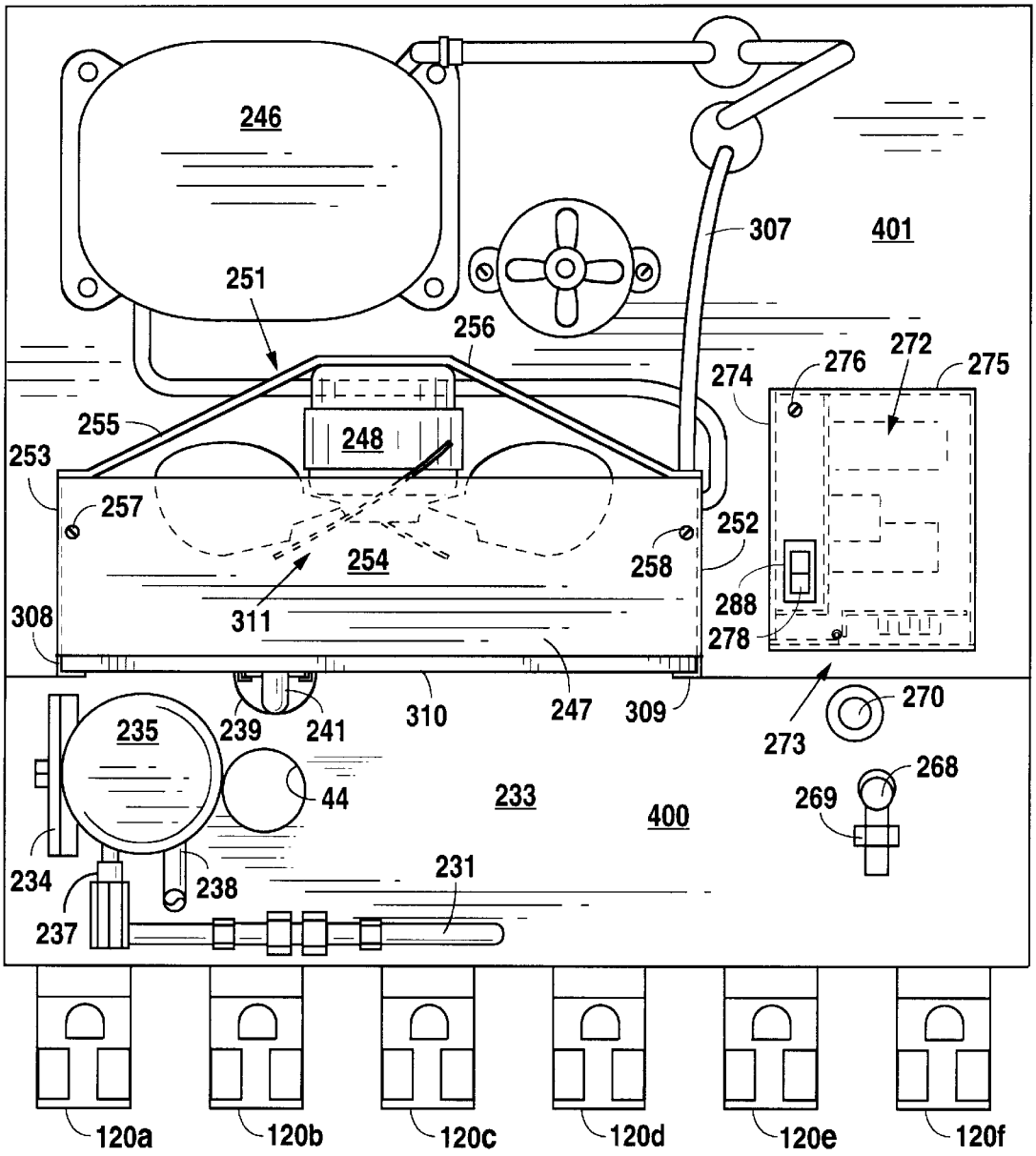
FIG. 9 is a top plan view illustrating the dispenser according to the preferred embodiment with its bonnet removed.
Figure 10:
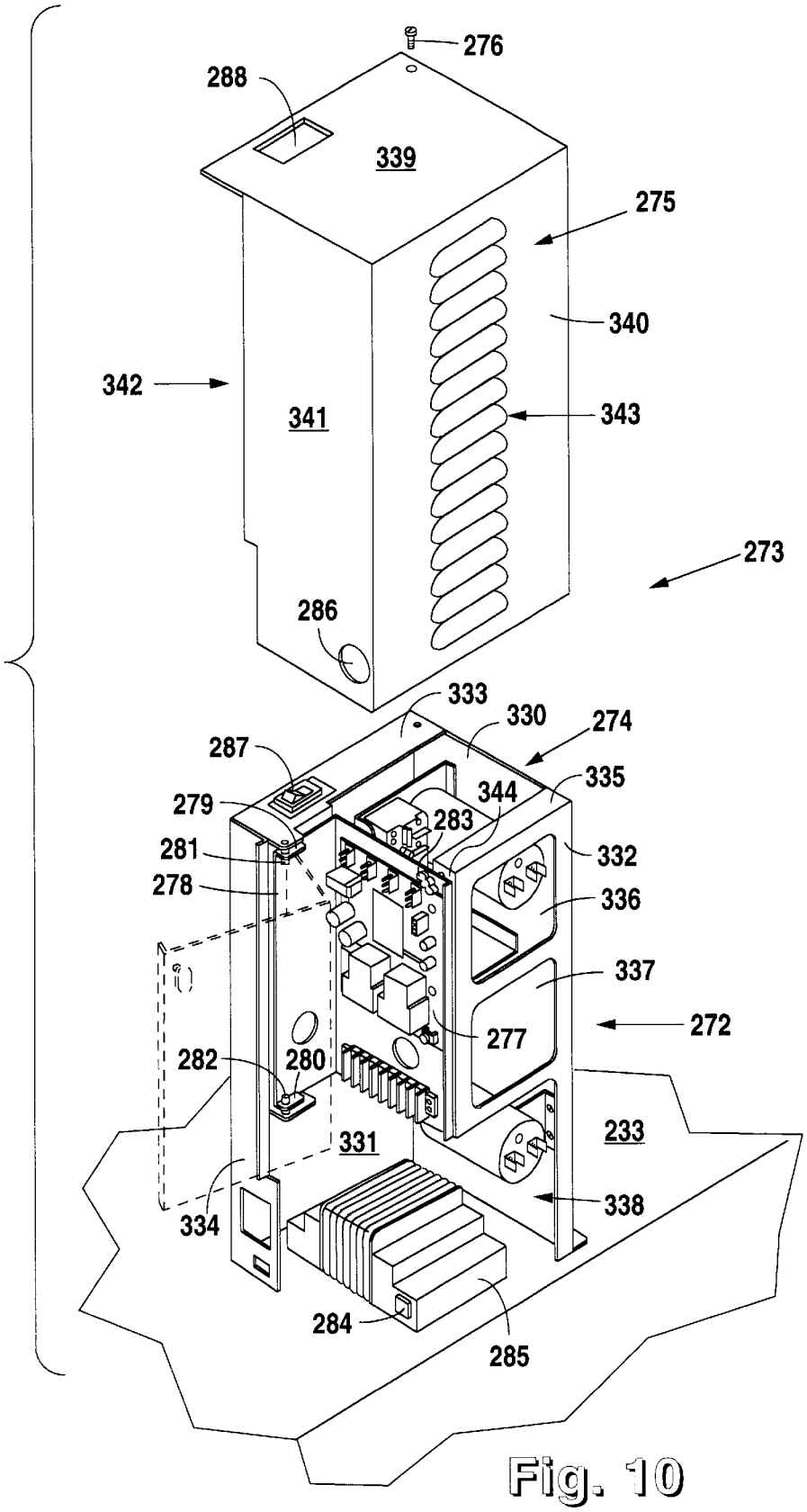
FIG. 10 is a perspective view illustrating the electronic control of the dispenser according to the preferred embodiment.
Figure 11:
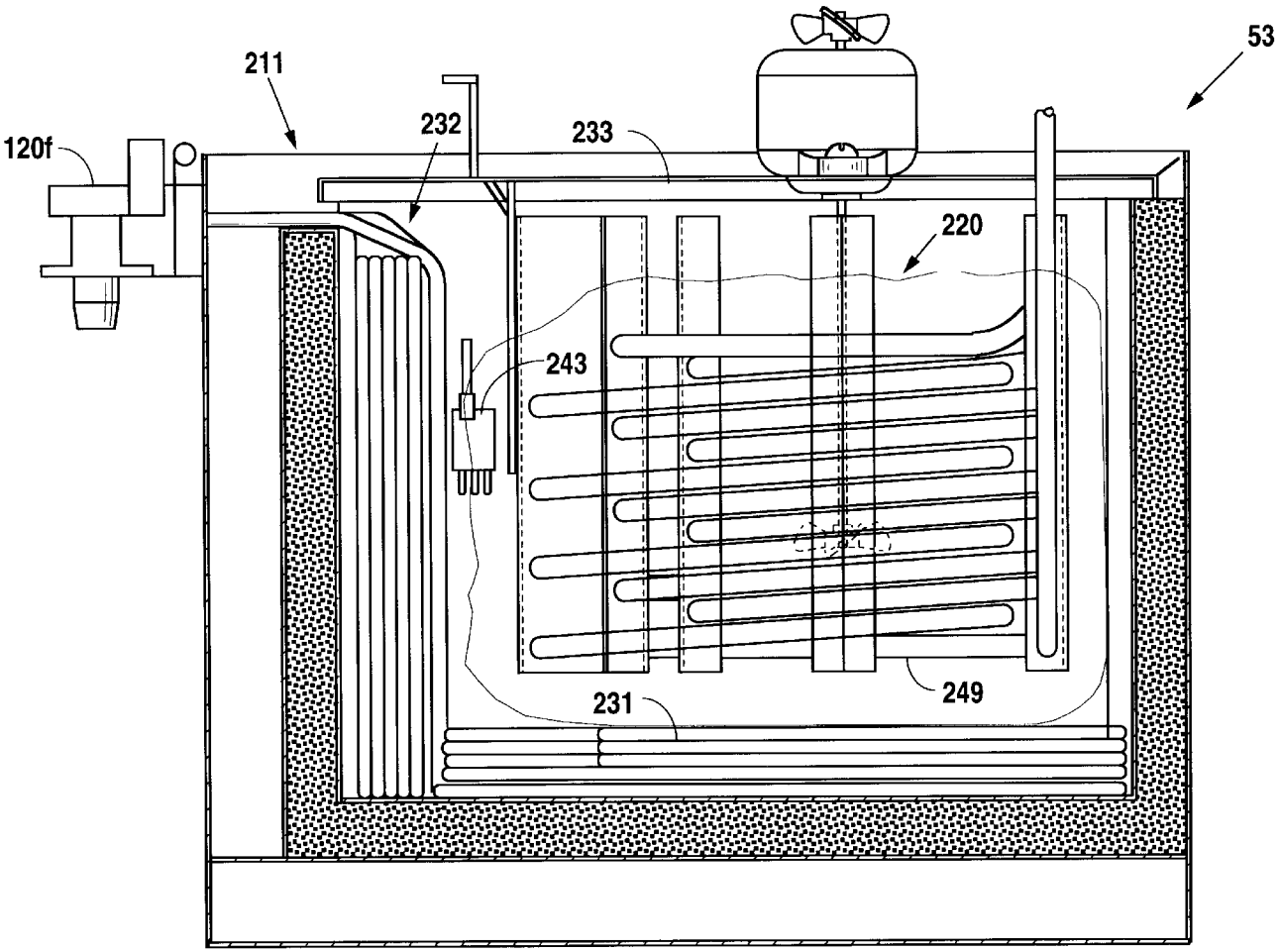
FIG. 11 is a right-side elevation view in cross-section illustrating the housing of the dispenser according to the preferred embodiment.

Aperture access member 90 of valve casing 80, positioned between internal support 85 and cover 86, permits access to valve adjustments 122*a–f* of valves 120*a–f* for altering syrup and water flow rates. Each valve 120*a–f* has one outlet for syrup and the other for carbonated or uncarbonated water and corresponding adjustments 122*a–f* for adjusting the ratio of syrup to water. Aperture access 90 has apertures 92*a–l* and knob 94, which protrudes through slot 200 of covering 86. Moving knob 94 toward end 202 of slot 200, as shown in FIG. 6*b*, aligns apertures 92*a–l* with valve adjustment apertures 82*a–l* of covering 86. This alignment permits adjusting the syrup and water with a screwdriver by inserting the screwdriver through apertures 82*a–l* and apertures 92*a–l* into valve adjustments 122*a–f*. When the servicing is completed, sliding knob 94 toward end 201 of slot 200 offsets apertures 82*a–l* and apertures 92*a–l* as shown in FIG. 6*a*.

As illustrated in FIGS. 1, and 8–11 the preferred dispenser 53 includes a cooling chamber 220 containing a water line 231 that connects at an inlet to a pump 236 (described herein) and at an outlet to a carbonator mounted within cooling chamber 20. Pump 236 connects at an inlet 38 to any suitable water source, such as a public water line, to pump water through water line 31 into the carbonator water. The carbonator is of a well known design and includes a gas inlet connected to a CO2 source such as a gas cylinder. The carbonator includes an outlet connected to a manifold that delivers carbonated water to dispensing valves 120*a–f* to permit the dispensing of carbonated beverages.

Cooling chamber 220 further contains product coils referenced generally with numeral 232. The exact number of product coils 232 corresponds to the number of dispensing valves 120*a–f*. Each of product coils 232 connects at an inlet to a respective product source, such as a "bag in a box" or a "figal". Each of product coils 232 further connects at an outlet to a respective one of dispensing valves 120*a–f*. A product pump associated with each product source resides intermediate to the product sources and product coils 232 to facilitate the delivery of product from the product sources, through product coils 232, and to dispensing valves 120*a–f*.

Dispenser 53 includes a bonnet 229 mounted onto housing 211 to provide dispenser 53 with an aesthetically pleasing appearance. Bonnet 229 includes a slot 230 that permits a technician to remove and replace a condenser filter without the necessity of detaching bonnet 229 from housing 211.

As illustrated in FIGS. 8–11, dispenser 53 includes a platform 233 that resides on top surface of housing 211. Platform 233 includes a first platform section 400 that supports a carbonator pump motor 235, a carbonator pump 236, a relief valve 268, a check valve 269, and a liquid level probe 270. Platform 233 further includes a second platform section 401 that supports an electronic control housing 273, a condenser 247, and a condenser fan 248.

Condenser 247 is of a well known design that condenses the refrigerant prior to delivery to evaporator coil 249 via capillary tube 307. Condenser 247 bolts at the left center portion of platform 233. Condenser 247 includes flanges 308 and 309 for retaining a condenser filter 310 that is removable through slot 230 in bonnet 229. Condenser fan motor 248 is of a well known design and mounts at the rear of condenser 247.

A shroud 251 mounts over condenser 247 to support condenser fan 248 behind condenser 247. Shroud 251 includes side casings 252 and 253 and a top casing 254 formed integrally with a rear casing (not shown). The rear casing includes an opening therethrough of sufficient size to allow the passage of blades 311 of condenser fan 248. Side casings 252 and 253 slide about condenser 247 until top casing 254 abuts the top surface of condenser 247. Shroud 251 attaches to condenser 247 via screws 257 and 258. Additionally, the bottom rear of condenser 247 includes a pair of tabs that engage the rear casing to secure the bottom of shroud 251.

Shroud 251 further includes brace members 255 and 256 that attach to opposing diagonal corners of the rear casing using any suitable means such as welding. The center portions of brace members 255 and 256 include openings therethrough that permit the bolting of condenser fan 247 to shroud 251. The sliding of shroud 251 onto condenser 247 and securing thereto with screws 257 and 258 permits easy attachment of condenser fan 248. Conversely, the removal of screws 257 and 258 and the sliding of shroud 251 off condenser 247 permits easy repair or replacement of condenser fan 248.

Dispenser 53 includes a carbonator pump 236 and a carbonator pump motor 235. In this preferred embodiment, pump motor 235 is a standard AC motor. An inlet 238 of pump 236 connects to the standard water source, while an outlet 237 connects to the water line 231 which, in turn, connects to the fluid inlet of the carbonator contained in cooling chamber 220. A brace 234 bolts at the front left corner of first platform section 400 to support motor 235 which bolts to brace 234. The housing of motor 235 resides above pump 236 and threadably engages the housing of pump 236 to support pump 236 above first platform section 400. The connection of the motor housing to the pump housing positions inlet 238 and outlet 237 facing forward to permit easy access by a technician.

A relief valve 268 and a check valve 269 reside at the right front portion of first platform section 400. Relief valve 268 and check valve 269 mount to a line that extends from the carbonator through an opening in first platform section 400. The line terminates in relief valve 268 and check valve 269 in a position above the right front portion of first platform section 400 to allow easy access by a technician.

A liquid level probe 270 of a well known design bolts at the right front portion of first platform section 400 behind relief valve 268. Liquid level probe 270 extends through first platform section 400 and accesses the interior of the carbonator. Liquid level probe 270 includes a water level sensor that measures the level of the water within the carbonator.

Dispenser 53 includes a cooling fluid bank size probe 239 positioned at the left front portion of platform 233 adjacent to pump 236 in front of condenser filter 310. The probe includes a fluid bank size sensor 243 of well known design mounted onto a dip stick 241 using any suitable means such as a bracket.

Dispenser 53 includes an electronic control 272 disposed within a housing 273 that is bolted at the right front portion of platform 233. The components and circuits comprising electronic control 272 are well known and include a relay and start capacitor for a compressor 246, a start capacitor for carbonator pump motor 235, a compressor control circuit that activates compressor 246 responsive to the output from cooling fluid bank size probe 239, a carbonator pump motor control circuit that activates motor 235 responsive to the water level output from liquid level probe 270.

Figure 4:
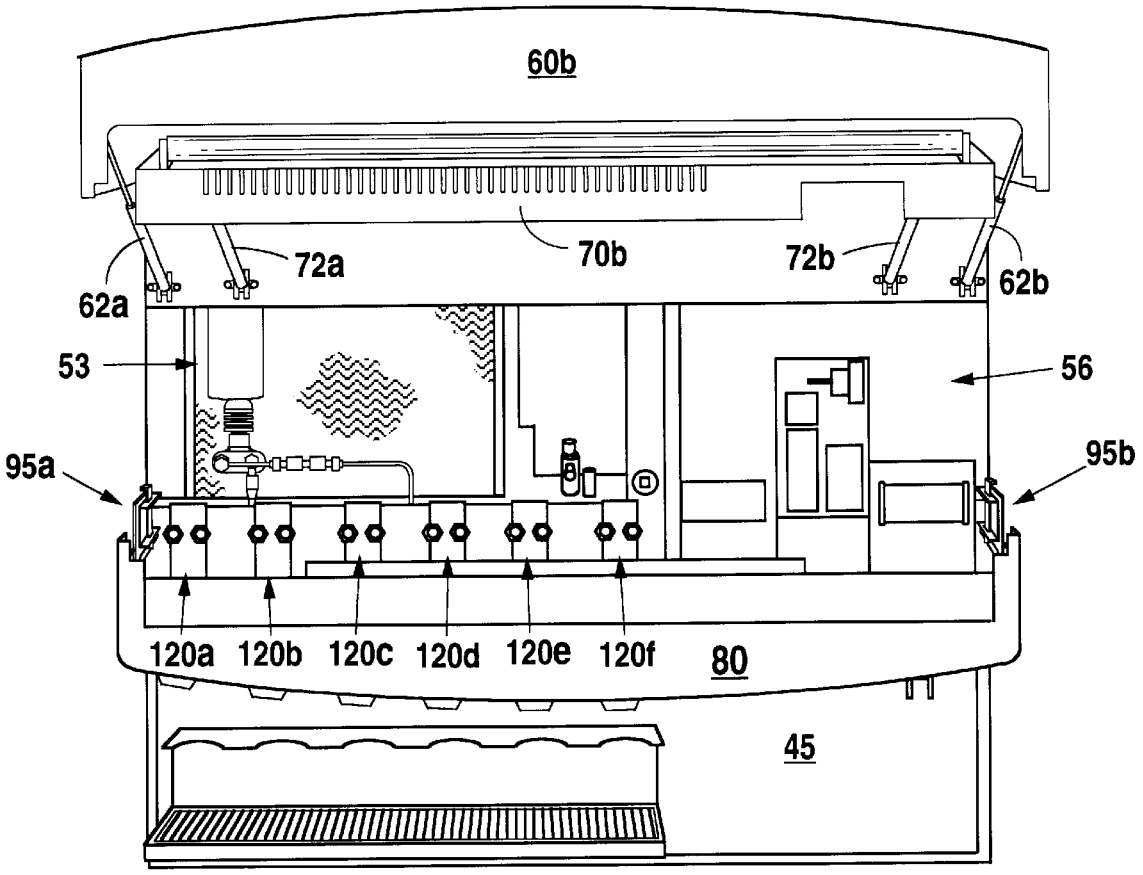
FIG. 4 is a front elevation view illustrating the dispenser housing with the valve casing in a fully open position.
Figure 5A:
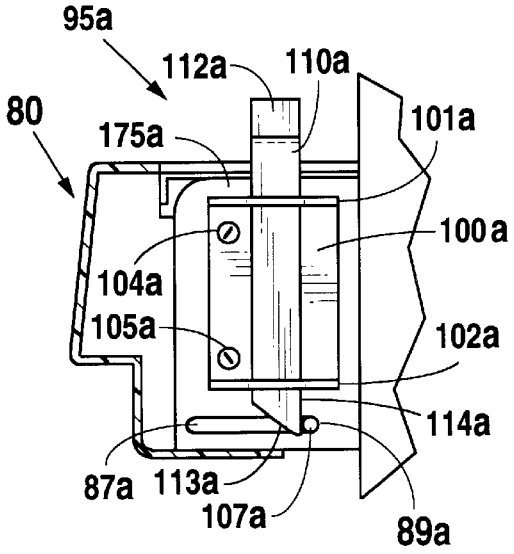
FIG. 5A is a side elevation view in partial cross-section illustrating the valve casing joint where the valve casing is in a closed positioned.
Figure 5B:
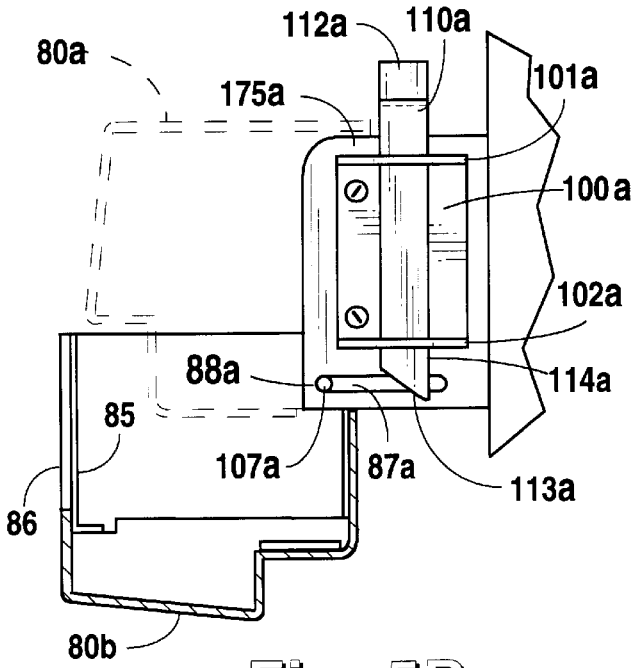
FIG. 5B is a side elevation view in partial cross-section illustrating the valve casing joint where the valve casing is in partially and fully open positions.

Housing 273 includes a frame 274 having a jacket 275 mounted thereabout (see FIG. 4). Frame 274 includes a casing member 330 formed integrally with casing members 331 and 332. Casing member 331 includes a top portion 333 and a front portion 334. Casing member 332 includes top portion 335, front portion 344, openings 336 and 337, and lower cut-out portion 338. Jacket 275 slides over frame 274 and is secured thereto with screw 276. Jacket 275 includes top casing member 339 formed integrally with casing members 340 and 341. Casing member 341 includes a cut-out portion 342 that is filled by front portion 334 of casing member 331 when jacket 275 resides over frame 274. Casing member 340 includes vents 343 that dissipate heat delivered from electronic control 272 via openings 336 and 337 and cut-out portion 338 of casing member 332.

The positioning of housing 273 towards the front of platform 233 combined with the easy removal of jacket 275 provides easy access to electronic control 272 from the front of dispenser 53. With jacket 275 placed over frame 274 and secured thereto, reset button 284 of compressor transformer 285 may be accessed through opening 286 in jacket 275. Similarly, main power switch 287 for electronic control 272 may be accessed through opening 288 in jacket 275.

The removal of jacket 275 exposes a circuit board 277 that contains the compressor control circuit and the carbonator pump motor control circuit. A door 278 supports circuit board 277 within frame 274. The circuit board attaches to door 278 using any suitable means such as plastic stand-offs. Door 278 is L-shaped and pivotally mounts to frame 274 via brackets 279 and 280 and pin 281 and 282. Pin 281 engages an aperture in top portion 333 of casing member 331, while pin 282 engages an aperture in a tab riveted to front portion 334 of casing member 331.

Door 278 locks within frame 274 at the end opposite from its pivotal attachment to casing member 331. Door 278 opens to allow a technician to access the power electronics required to operate compressor 46 and carbonator motor 35. With door 278 opened and pivoted away from casing member 332, a technician can easily repair or replace the power electronics of electronic control 272.

A major advantage of dispenser 53 is that a technician may easily service it from the front. The condenser filter 310 may be removed and replaced through slot 230 without the necessity of removing bonnet 229. With the removal of bonnet 229, a technician may easily access carbonator pump motor 235, pump 236, the frozen cooling fluid bank size probe 239, relief valve 268, check valve 269, and carbonation probe 270, all of which reside in front of platform 233. Additionally, condenser 247 and condenser fan 248 reside behind carbonator pump 236 and carbonator motor 235, however, as previously described, condenser fan 248 easily slides from condenser 247 due to its connection to shroud 251.

Electronic control 272 resides in the right center portion of the platform directly behind relief valve 268, check valve 269, and liquid level probe 270 to permit easy access. As previously described, a technician may reset the transformer or deactivate the main power supply without removing jacket 275. Additionally, with jacket 275 removed, circuit board 277 is easily accessible as well as the power electronics which are exposed upon the pivoting of door 278.

From the foregoing description and illustration of this invention, it is apparent that various modifications may be made by reconfigurations or combination producing similar results. It is, therefore, the desire of the applicant not to be bound by the description of this invention as contained in this specification, but be bound only by the claims as appended hereto.

We claim:

1. A dispenser housing, comprising:

an enclosure for receiving a dispenser therein, wherein said enclosure includes an opening that permits access to the dispenser;

a first access member secured to said enclosure, wherein said first access member is pivotally movable along a first direction between a first position covering a portion of the opening of said enclosure and a second position that provides access to the dispenser through a first portion of the opening of said enclosure; and a valve casing secured to said enclosure, wherein said valve casing is pivotally movable along a second direction opposite to the first direction between a first position covering a portion of the opening of said enclosure and a second position that provides access to the dispenser through a second portion of the opening of said enclosure.

2. The dispenser housing of claim 1 wherein said first position of said first access member is substantially vertical and said second position of said first access member is substantially horizontal.

3. The dispenser housing of claim 1 wherein said first access member is releasably lockable in said second position.

4. The dispenser housing of claim 1 wherein said valve casing further comprises:

at least one aperture and a slot; and an aperture access member having at least one valve adjustment aperture and a knob wherein said knob protrudes through said slot permitting movement of said knob for aligning said aperture of said aperture access member with said aperture of said valve casing, thereby permitting access to a valve adjustment switch therein.

5. The dispenser according to claim 1 further comprising a second access member positioned proximate to said first access member and pivotally movable between a first position and a second position that provides access to the dispenser, wherein said second access member includes a light source that illuminates the dispenser when said second access member is in its second position.

6. A dispenser housing, comprising:

an enclosure for receiving a dispenser therein, wherein said enclosure includes an opening that permits access to the dispenser;

a first access member secured to said enclosure, wherein said first access member is pivotally movable between a first position and a second position that provides access to the dispenser; and a second access member positioned proximate to said first access member and pivotally movable between a first position and a second position that provides access to the dispenser, wherein said second access member includes a light source that illuminates the dispenser when said second access member is in its second position.

7. The dispenser housing of claim 6 wherein said first position of said second access member is substantially vertical and said second position of said second access member is substantially horizontal.

8. The dispenser housing of claim 6 wherein said second access member is releasably lockable in said second position.

9. The dispenser housing according to claim 6 wherein the dispenser further comprises a valve casing secured to said enclosure, wherein said valve casing is pivotally movable between a first position and a second position that provides access to the dispenser.

10. The dispenser according to claim 6 wherein said valve casing further comprises:

at least one aperture and a slot; and an aperture access member having at least one valve adjustment aperture and a knob wherein said knob protrudes through said slot permitting movement of said knob for aligning said aperture of said aperture access member with said aperture of said valve casing, thereby permitting access to a valve adjustment switch therein.

11. A jointed connection for a valve casing of a soda dispenser housing, comprising:

at least one valve casing joint comprising:

a plate having a plurality of legs extending therefrom wherein each of said legs has an aperture therethrough;

a lever insertable through said apertures; and a pin releasably engageable with said lever to permit longitudinal and pivotal movement of said valve casing.

12. A dispenser unit, comprising:

a dispenser comprising at least one valve and one valve adjustment switch; and a housing having a face comprising:

a first access member pivotally movable between a first position covering the dispenser and a second position providing access to the dispenser, and a valve casing pivotally movable between a first position covering the valve of the dispenser and a second position providing access to the valve of the dispenser, said valve casing comprising a covering having at least one aperture and a slot and an aperture access member having at least one aperture and a knob protruding through said slot, wherein movement of said knob within said slot aligns said aperture of said aperture access member with said aperture of said covering, thereby permitting access to the valve adjustment switch of the valve.

* * * * *